US006070447A

United States Patent [19]

Bone et al.

[11] Patent Number: 6,070,447

[45] **Date of Patent: *Jun. 6, 2000**

[54] BASE FORMING STATION

[75] Inventors: Robert Bone, East Barnet; William Gray, Watford; Paul Porucznik, Oxford, all of United Kingdom

[73] Assignee: Innotek Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/981,872

[22] PCT Filed: Apr. 24, 1997

[86] PCT No.: PCT/GB97/01127

§ 371 Date: Apr. 10, 1998

§ 102(e) Date: Apr. 10, 1998

[87] PCT Pub. No.: WO97/41978

PCT Pub. Date: Nov. 13, 1997

[30] Foreign Application Priority Data

May 4, 1996 [GB] United Kingdom ..... 9609407

[51] Int. Cl.[7] ..... B21D 22/28

[52] U.S. Cl. ..... 72/348; 72/366.8

[58] Field of Search ..... 72/343, 348, 466.8

[56] References Cited

U.S. PATENT DOCUMENTS 5,125,257 6/1992 Worwag et al. ..... 72/348

5,154,075 10/1992 Hahn et al. ..... 72/348

5,272,902 12/1993 Kobak ..... 72/348

FOREIGN PATENT DOCUMENTS 2256388 5/1992 United Kingdom .

WO/86/02026 9/1985 WIPO .

*Primary Examiner*—Lowell A. Larson

*Attorney, Agent, or Firm*—Ratner & Prestia

[57] ABSTRACT

An apparatus is provided for forming a profile in an end wall of a drawn or drawn and wall ironed container on a punch. The apparatus includes a shape forming pad for deforming a central portion of the end wall to the desired profile, the shape forming pad being resiliently supported in a housing for limited motion relative to the housing in the direction of travel of the punch. The shape forming pad is preferably fixed to a floor of a hollow inner housing, a side wall of the hollow inner housing having an outwardly directed flange. The housing of the apparatus includes a peripheral flange to permit fixing to a press, and a side wall portion of the housing being closed at one end to contain resilient support means for the shape forming pad. The outwardly directed flange of the hollow inner housing overlaps the peripheral flange of the housing, thereby transmitting impact load on the shape forming pad through the peripheral flange.

23 Claims, 6 Drawing Sheets

SECTION X-X

SECTION X-X

SECTION X-X

BASE FORMING STATION

BACKGROUND OF THE INVENTION

This invention relates to apparatus for forming an outwardly concave profile on an end wall of a container on a punch moveable towards and away from the apparatus, and more particularly, but not exclusively to the dome forming station on a press forming can bodies.

Dome forming stations are described in U.S. Pat. No. 4,930,330 (WEISHALLA) and U.S. Pat. No. 4,372,143 (ELERT) in which the dome forming apparatus comprises a dome forming pad surrounded by a clamp ring having a profile to receive a can bottom as drawn, and resiliently hold a peripheral portion of the can bottom against a peripheral end wall portion of the advancing punch. Although these doming stations have been used commercially they are vulnerable to wear leading to diminished accuracy of alignment.

WO 89/07021 (ADOLF COORS) describes dome forming apparatus in which a relatively rigidly supported dome forming tool is surrounded by a first sleeve resiliently urged to act on an inner annulus of a can bottom while a second sleeve or holder is resiliently urged against a peripheral portion of the can bottom against the dome forming tool. These prior art forming tools are all vulnerable to sliding wear, a risk made greater as clearances increase to permit ingress of dirt or debris.

SUMMARY OF THE INVENTION

This invention seeks to provide apparatus having resilient independent support for each of the dome forming tool, the holding ring, and an ejector sleeve and rapid return to original position. A further objective is to provide a compact apparatus capable of being mounted in the"domer door" of a wall—ironing machine to avoid outrigged cantilever loads and risk of fatigued failure of the mounting bolts which hitherto have been subjected to rapid tensile cyclic load.

Accordingly this invention provides apparatus for forming a profile in an end wall of a drawn or drawn and wall ironed container on a punch, said apparatus comprising: a shape forming pad for deforming a central portion of the end wall to the desired profile, characterised in that: the shape forming pad is resiliently supported in a housing for limited motion relative to the housing in the direction of travel of the punch; said housing includes a peripheral flange to permit fixing to a press, and a side wall portion closed at one end to contain resilient support means for the forming pad.

In a preferred embodiment, the apparatus further comprises a resiliently supported holding ring surrounding the shape forming pad, wherein the holding ring is resiliently supported to co-operate with the punch to impose a holding force on a peripheral portion of the end wall of the container, and the side wall portion of the housing further includes support means for the holding ring.

The holding ring may be supported by fluid pressure, such as compressed air or gas acting on a first piston having a stem to bearings to prevent tilt.

In a further embodiment, the apparatus may include a resiliently supported sleeve interposed between the shape forming pad and the holding ring, the side wall portion of the housing further including support means for the sleeve for ejecting the container after forming the desired end profile. In this embodiment, the first piston has a hollow stem which guides a second piston to urge the ejector sleeve to rise after shaping of the end wall of the drawn container.

The shape forming pad may be guided by an array of linear roller bearings. Preferably a first pair of linear bearings supports the underside of the shape forming pad whilst a pair of adjustable linear bearings is located above the axis of travel of the pad to maintain pad guidance.

In a preferred embodiment the housing comprises an outer housing and the shape forming pad is fixed to a floor of a hollow inner housing, the side wall of which has an outwardly directed flange extending radially beyond the linear bearings.

The flange of the inner housing is supported on an array of springs in the outer housing. Preferably an array of polyurethane springs is used, each polyurethane spring being a loose fit in a cavity in the outer housing to permit expansion of girth when compressed. In a preferred embodiment the cavities are connected by a passageway to permit introduction of a pressurised fluid, such as compressed air or gas, to assist elastic recovery of the polyurethane springs after release of a compressive load.

Fluid pressure may be contained in the cavities by a first seal between the flange of the inner housing and a retaining annulus fixed to the outer housing, and a second seal between the side wall of the inner housing and the side wall of the outer housing.

Typically the flange of the inner housing is moveable by about ⅛" (3.175 mm) to cope with can crashes or double feeds but in normal use the polyurethane springs will limit motion to about one to two can bottom thicknesses.

The flange of the inner housing is retained in the housing by an annular plate, a wiping seal being provided between the flange and plate to contain air pressure used to assist the return movement of the flange and prevent ingress of coolant or debris into the housing. Preferably a further seal is provided between the side wall of the inner housing and outer housing to complete sealing of the cavities.

When a first piston having a stem is used, it is possible to prevent tilt of the piston in the housing by means of bearings at the stem so that the periphery of the piston may be slack in a liner located in the housing. Seal is made by piston rings. Preferably the stem is guided by re-circulating ball bushes in a hollow plinth at the closed end of the housing and the piston rings preferably include a graphite ring.

Lifting pressure from the first piston is passed to the holding ring by pressure pins passing through the floor of the inner housing.

The second piston is urged to move by air delivered through a passageway extending from the side wall of the housing to the hollow plinth supporting the hollow stem of the first cylinder. Pressure pins may be used to pass lifting force from the second piston to the ejector sleeve.

Both the pressure pins for the holding ring and for the ejector sleeve may be further guided by bearings in a transverse wall of the housing.

Preferred embodiments of the invention will now be described by way of example and with reference to the accompanying drawings in which:

DESCRIPTION OF THE PREFERRED EMBODIMENTS

Figure 1:
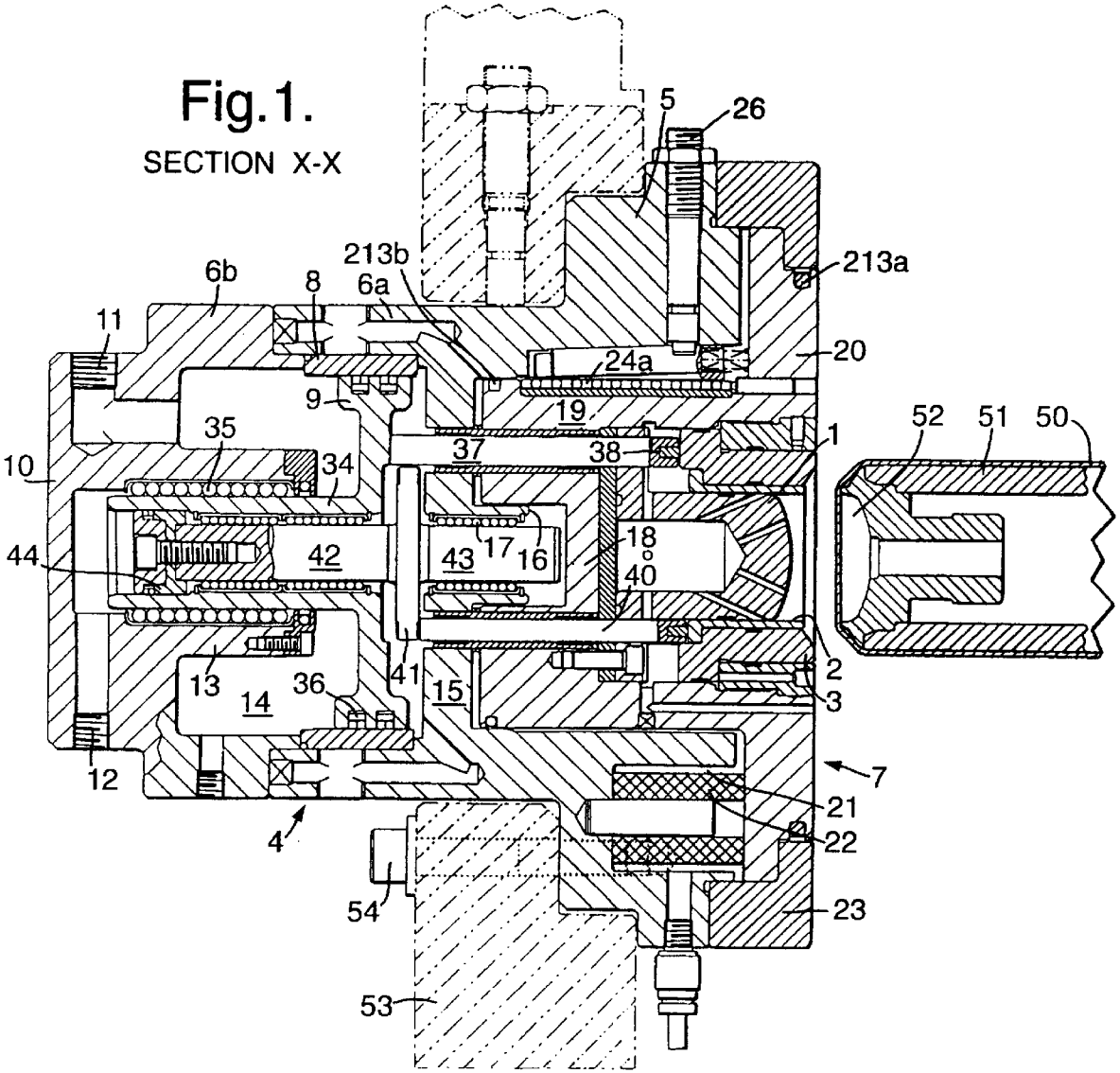
FIG.1 is a side view of apparatus sectioned on line X—X in FIG. 2;.

FIG. 1 shows apparatus comprising a shape forming pad 1, a resiliently supported ejector sleeve 2 surrounding the pad 1, a resiliently supported holding ring 3 surrounding the ejector sleeve 2, in a housing 4 in which the pad 1, ejector sleeve 2 and holding ring 3 are retained for limited motion along the central axis of the shaping pad.

The housing 4 has a peripheral flange 5 extending inwards to an upper side wall 6*a* which surrounds an inner housing 7 to which shape forming pad 1 is fixed; a lower side wall portion 6*b* which surrounds a liner 8 and piston 9 arranged to drive the holding ring; and an end wall 10 having a first passageway 11 to deliver compressed air to holding piston cavity and second passage way 12 to lead compressed air to a hollow plinth 13 extending from the end wall 10 into the piston cavity 14. A wall 15 extending across the housing 4 between the piston 9 and inner housing 7 has a tubular flange 16 to support a bearing 17, and holes through which push rods pass.

It will be understood that in this embodiment the holding ring 3, and ejector sleeve 2 are supported by air pressure from cavities such as 14, to the left of FIG. 1 while the shape forming pad 1 is supported differently.

The inner housing 7 has a floor 18, supporting the shape forming pad 1, a side wall 19 extending from the periphery of the floor 18 to surround the pad 1 and a flange extending laterally from the open end of the side wall. A shim may be placed between the shape forming pad and floor of the inner housing 7 to achieve a desired spacing. The flange 20 of the inner housing 7 extends over an array of cavities 21 in the flange 5 of the housing 4 as shown in FIG. 2 in which the inner housing is shown in section but the retaining annulus is not shown so that the transverse wall 15 and tubular flange 16 are visible.

Each cavity 21 contains a resilient spring 22, in this case a cylinder of polyurethane of diameter slightly less than the diameter of its cavity 21. The array of polyurethane springs urges the flange 20 of the inner housing away from the flange 5 against a retaining annulus 23. The retaining annulus 23 is provided with a seal 213*a* which makes a wiping seal with the periphery of flange 20 as the inner housing moves during use of the apparatus, so reducing risk of entry of dust or debris into the cavities 21. of the cavities 21 is connected to the next by an annular passageway under flange 20 of the inner housing to permit introduction of pressurised fluid, such as compressed air or nitrogen, to assist elastic recovery of the polyurethane springs after release of compressive load.

The pressurised fluid is contained in the annular cavity defined by the cavities 21, the underside of flange 20 and side wall 19 of the inner housing, the interior of the side wall 6*a* of the outer housing 4 and the retaining annulus 23. As shown in FIG. 1 a wiping seal 213*a* provided between the retaining annulus 23 and periphery of flange 20. There is a further wiping seal 213*b* between the side wall of the inner housing and interior surface of the upper side wall 6*a*.

Figure 2:
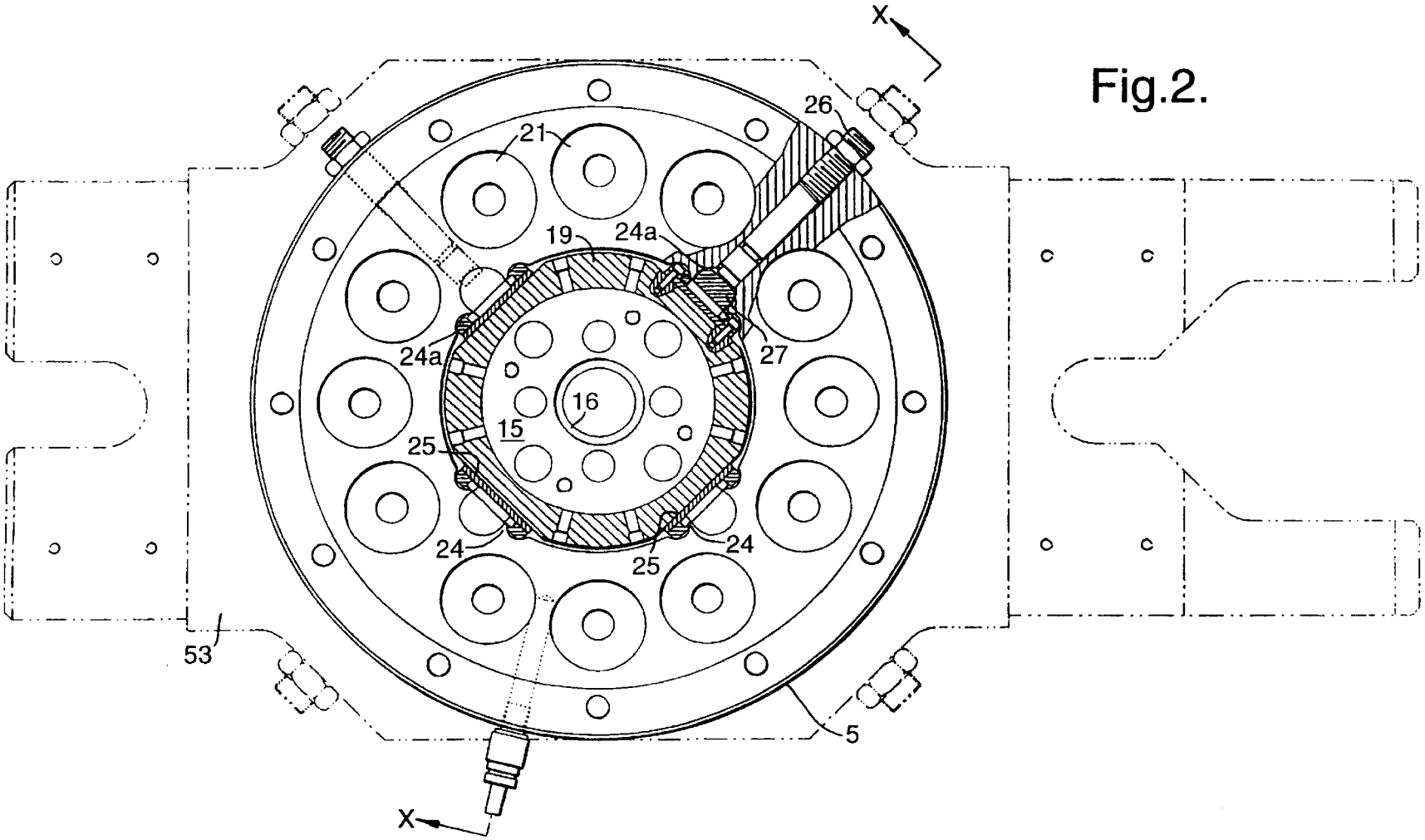
FIG. 2 is an end view of the housing cut away to show slide adjusters.

FIG. 2 shows four linear bearings 24 to support co-operating flat surfaces 25 on the side wall of the inner housing 7. This apparatus for shaping the bottom of a drawn container is usually used with the axis of press punch and shape forming pad horizontal. In FIGS. 2 and 3*b* the lower pair of bearings 24 are supported on cylindrical pins 55 rotatable in arcuate recesses 56 in the housing. Each pin 55 has a chordal flat surface 57 to support the rolls of a linear bearing 28 as they support the flat surfaces 25 of the side wall 19 of the inner housing 7 to provide a datum line parallel to the axis of motion of the inner housing as can be seen in FIG. 3*b*. At least the upper pair of bearings 24*a* are adjustable.

Figure 3A:
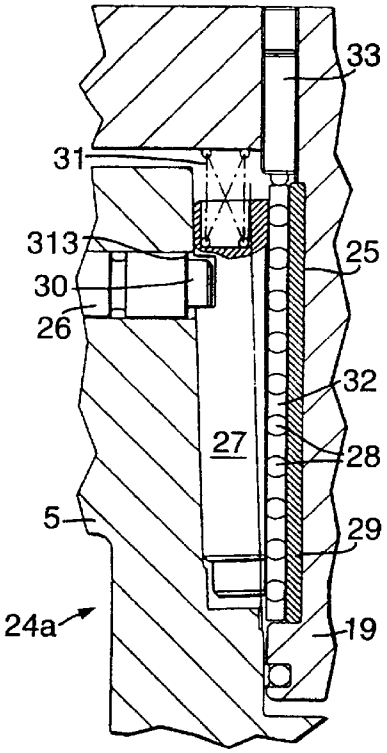
FIG. 3*a* is an enlarged fragmentary view of an adjuster for a linear bearing and inner housing.
Figure 3B:
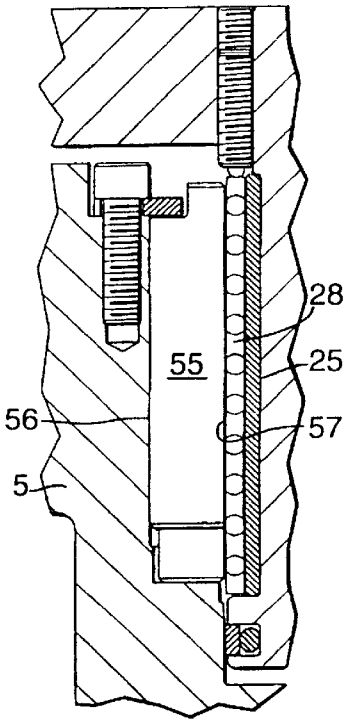
FIG. 3*b* is an enlarged fragmentary view of a non-adjustable inner bearing.

One of the adjustable bearings 24*a* is shown enlarged in FIG. 3*a* to comprise an adjuster screw 26, a round backed wedge 27, a linear roller bearing 28, and a wear plate 29 on the side wall 19 of the inner housing 7. The adjuster screw 26 has an eccentric pin 30 projecting from its end face into a groove in the wedge so that rotation of the screw raises or lowers the wedge to take up any slack in the bearing while the round back of the wedge is able to rotate as necessary in its recess in the housing to align co-operating rolls 28 with the side wall of the inner housing. FIG. 3*a* shows a clearance between the top side of eccentric pin 30 and the groove so that if wear occurs at the bearing 28 the spring 31 is able to adjust the wedge pressure automatically while the inner housing is continuously guided. The linear roller bearing is typically steel rollers held apart by a cage 32 in the form of a strip. The cage is urged against an abutment in the side wall 19 by a pressure pin 33.

Typically the inner housing 7 is capable of about ⅛" (3.175 mm) of motion in the housing but the polyurethane springs will yield a distance only about twice the thickness of the container bottom in normal use. The extra movement available is provided to make space for"double feeds" of two cans at a time or other accidents. Provision of the flange 5 at the"forward end" of the apparatus permits this apparatus to be fitted in front (ie on the punch side) of the "domer door" or supporting portion of the press, an advantage being that the mounting bolts are no longer put in tensile fatigue load supporting the cantilever weight of the apparatus.

The holding ring 3 is supported on push rods 37 passing through the wall 15 to the piston 9 which is supported by compressed air in the chamber 14 defined by the lower side wall 6*b* and the end wall 10. Piston 9 has a hollow stem 34 moveable in a recirculating ball bush 35 the hollow plinth 13 to maintain a clearance all round the piston 9 and interior of the liners while controlling the direction of travel of the piston 9. The piston 9 is therefore not a tight fit in the liner 8 because an adequate air seal is achieved by use of piston rings. Preferably low friction rings are used such as graphite piston rings 36 so that wear on the liner 8 is minimised. The push rods are accurately ground to length and, if desired, may include a polyurethane buffer to attenuate vibration, as also do the polyurethane springs 22 in the housing flange cavities 21. Air introduced through inlet 12 into cavity 14 urges piston 9 to raise push rods 37 to move holding ring 3 against the approaching can bottom.

The ejector sleeve 2 is supported on push rods 40 passing through bearings in the wall 15 to be supported on disc 41 having a stem which is supported on by a recirculatory ball bush in the stem 34 of piston 9 for accurate alignment with the axis of the shape forming pad 1. A second stem 43 extends from the disc 41 into a further recirculating ball bush 17 in the tubular flange 16 on wall 15. A piston 44 at the end of stem 42 is urged to move, when required, by air pressure supplied through passage way 12 into the hollow plinth 13.

It will be noticed that a cavity in the underside of floor 18, of the inner housing, permits the inner housing to partly surround the flange 16 making the apparatus more compact in length without loss of bearing length to spread load and reduce wear.

FIG. 1 also shows the apparatus ready to receive a flat bottomed drawn can body 50 on a punch 51 having an outwardly concave cavity 52 in its free end. The apparatus is supported in a recess on the approach side of the "dome door" 53 so called because it may be hinged plate at the end of the punch stroke of a press making drawn and wall ironed cans. FIG. 2 shows more detail of the dome door 53 and portions to be fixed to a press. The compact apparatus described permits fixing by bolts 54 through flange 5 to the door 53 while the weight of the apparatus is carried by the doors so the bolts 54 are spared a cyclic cantilever tensile load that would arise if the apparatus is simply bolted to the distant face of the door 53 as was prior art practice which gave rise to fatigue failure of mounting bolts.

Figure 4:
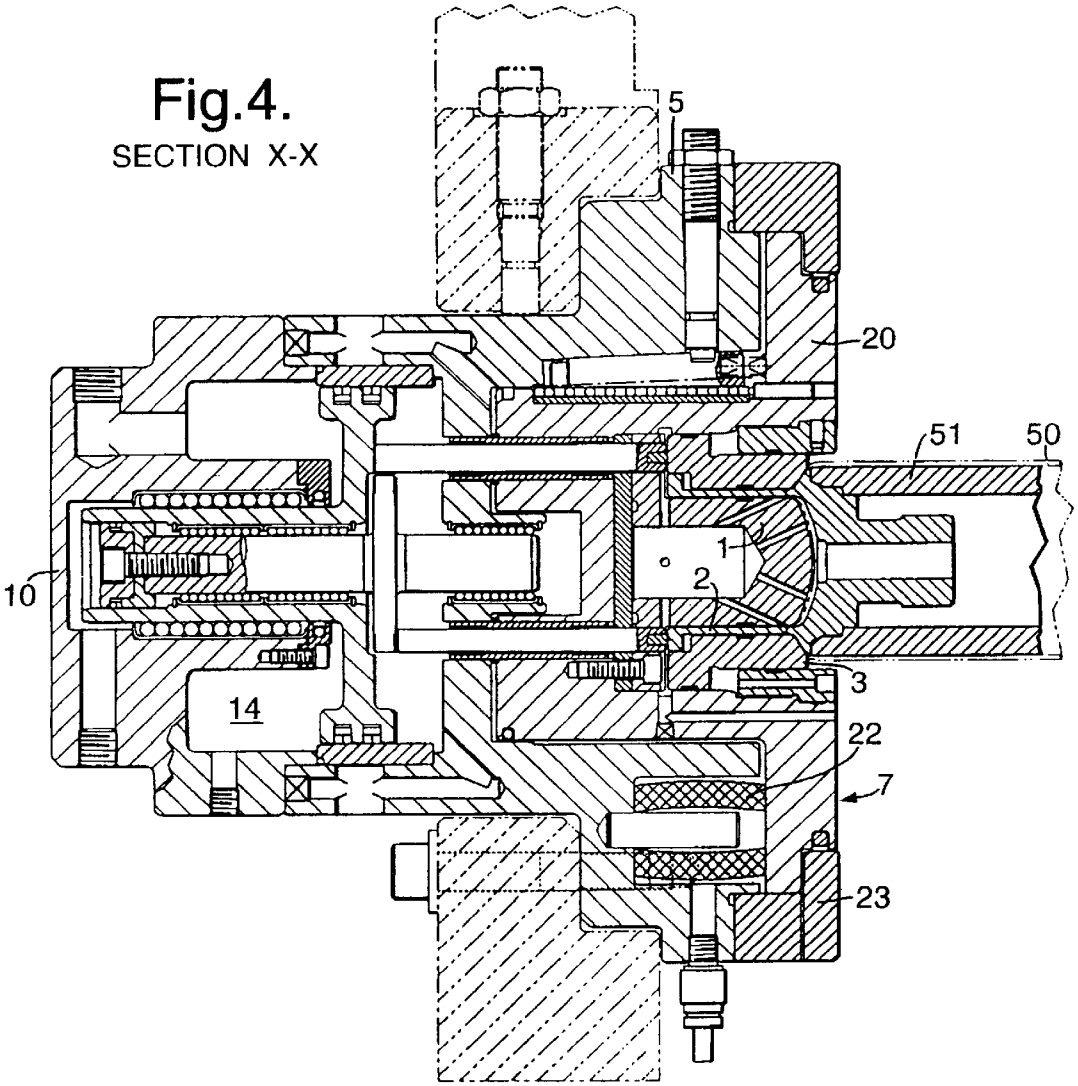
FIG. 4 is a sectioned side view of the apparatus after forming the shape of a bottom end of a can.

FIG. 4 shows the apparatus of FIG. 1 at a time when the punch 51 has arrived at the end of its stroke and cavity 52 of the punch has received the shape forming pad to form the flat end wall of the drawn can body 51 into an outwardly concave dome. Holding ring 3 and ejector sleeve 2 have been moved towards the piston cavity 14, air pressure in which has imposed a resilient holding load on the piston which is transferred to the conical periphery of the drawn can body to prevent wrinkling.

If desired, the end of the ejector sleeve may be shaped to be complimentary to the annulus of container bottom presented to it so that holding load against the advancing punch is shared between the holding sleeve and ejector sleeve.

Figure 5:
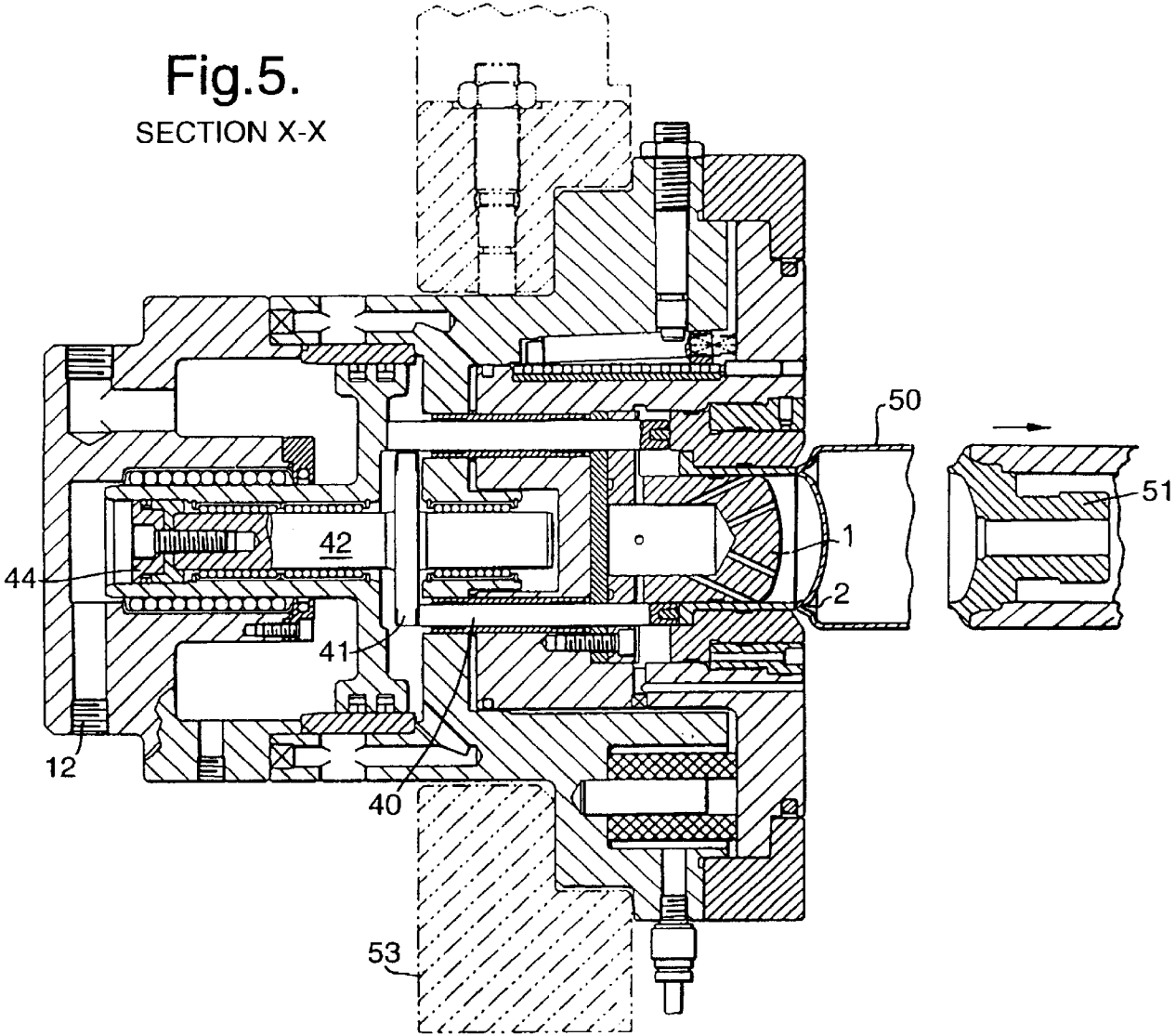
FIG. 5 is a like view of the apparatus after ejection of the finished can.

FIG. 5 shows the apparatus of FIGS. 1 and 2 after air supplied through passage way 12 has urged piston 44 to rise so lifting the ejector sleeve 2 which urges the stand bead of the domed can quickly away from the shape forming pad 1.

Figure 6:
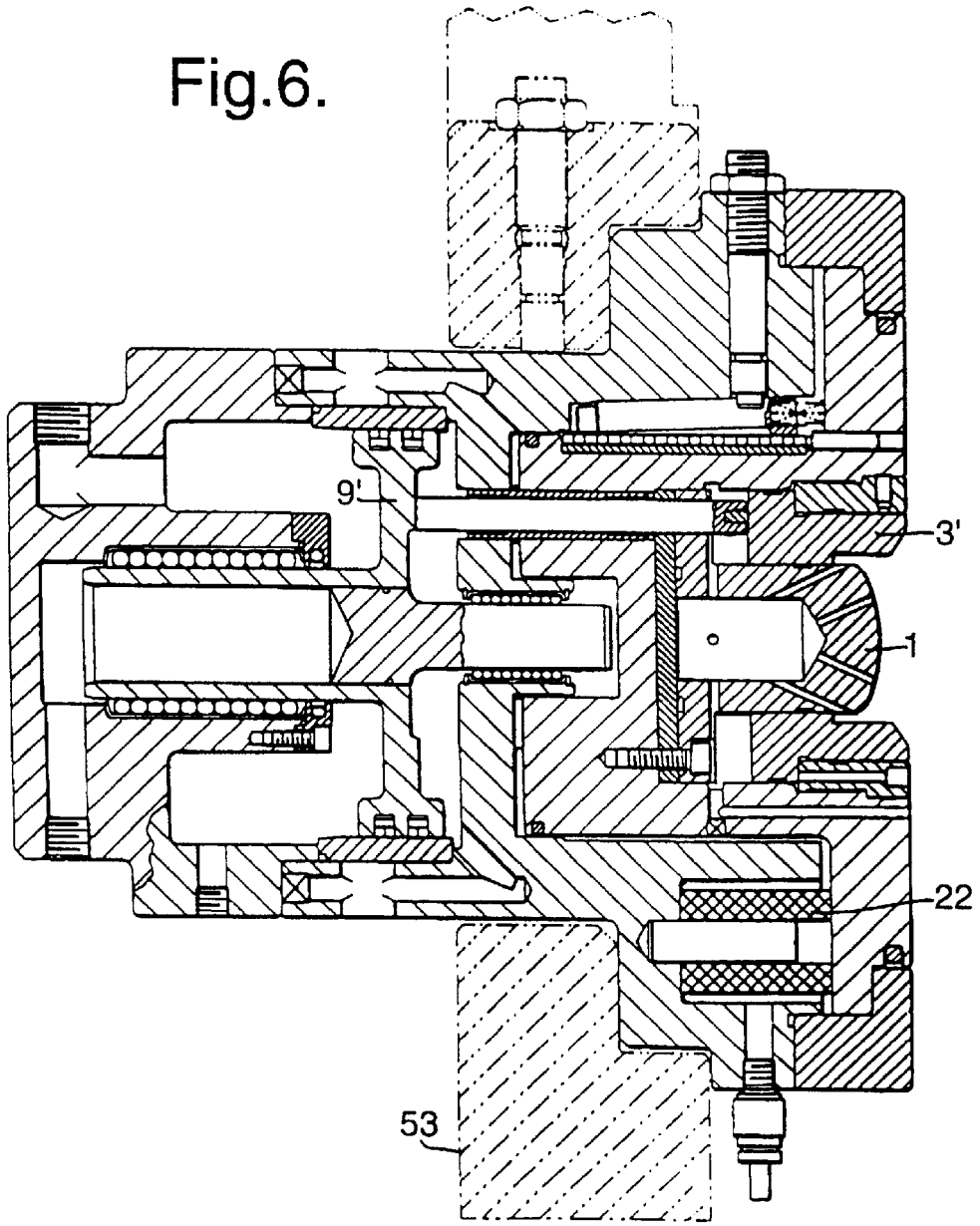
FIG. 6 is a view similar to that of FIG. 5, for a second embodiment of the invention.

FIG. 6 shows how the invention may be used for presses in which the dome profile is formed at lower speeds. In such presses, which operate at slower speeds, the stripping action provided by ejector sleeve 2 is not required. As a result, the apparatus of FIG. 6 lacks push rods 40, piston 9 and associated components. It can be seen that the holding ring 3' of FIG. 6 is modified so that there is no gap left by the omission of ejector sleeve 2. The piston 9' has also been modified and will, most usually, be hollow so as to reduce weight.

In accordance with the teaching of the present invention, however, the apparatus of FIG. 6 still includes resilient support for the doming pad 1 in the form of array of polyurethane springs 22. Furthermore, the apparatus is still mountable by flange 5 directly to the domer door, thus avoiding adverse cantilever effects experienced in prior art apparatus.

Figure 7:
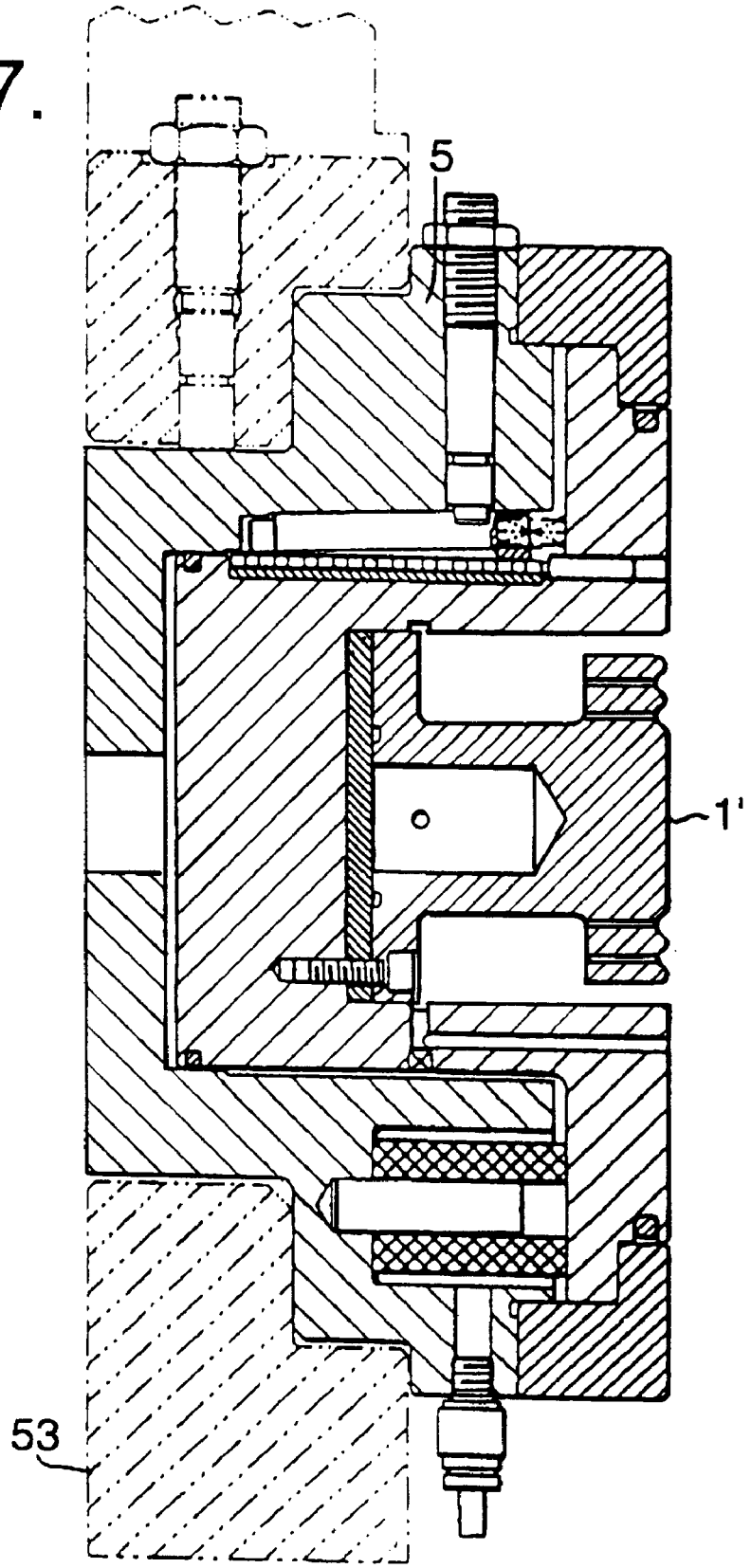
FIG. 7 is another view similar to that of FIG. 5, for a third embodiment of the invention.

FIG. 7 shows a version of the apparatus of the present invention which has been further simplified for use as a single action base forming apparatus such as is required for forming food can ends. A food can end typically comprises a shallow cup with a series of annular beads to permit flexing of the end in use. These ends are also manufactured at slower speeds than ends which are manufactured using the apparatus of FIG. 5. Due to the shallow nature of the cup and the slow line speeds, these ends can be removed from the press without any stripping action. Thus neither the ejector ring 2, nor the holding ring 3, 3' of the earlier embodiments are required. However, a pressurised fluid may still be introduced to speed recovery of the polyurethane springs.

It will be appreciated that modifications to the apparatus may be made to the apparatus of FIGS. 6 and 7 within the scope of the invention as claimed. For example, the gap behind base forming pad 1' of FIG. 7 may be filled in order to avoid build up of dust or grease during operation.

We claim:

1. Apparatus for forming a profile in an end wall of a drawn or drawn and wall ironed container on a punch, said apparatus comprising:

a shape forming pad for deforming a central portion of the end wall to the desired profile, the shape forming pad being resiliently supported in a housing for limited motion relative to the housing in the direction of travel of the punch, said shape forming pad being fixed to a floor of a hollow inner housing, a side wall of said hollow inner housing having an outwardly directed flange;

said housing includes a peripheral flange to permit fixing to a press, and a side wall portion of said housing being closed at one end to contain resilient support means for the shape forming pad; and said outwardly directed flange of said hollow inner housing overlaps said peripheral flange of said housing, thereby transmitting impact load on said shape forming pad through said peripheral flange.

2. An apparatus according to claim 1, further comprising a resiliently supported holding ring surrounding the shape forming pad, wherein the holding ring is resiliently supported to co-operate with the punch to impose a holding force on a peripheral portion of the end wall of the container, and the side wall portion of the housing further includes support means for the holding ring.

3. An apparatus according to claim 2, further comprising a resiliently supported sleeve interposed between the shape forming pad and the holding ring, the side wall portion of the housing further including support means for the sleeve for ejecting the container after forming the desired end profile.

4. Apparatus according to claim 3, wherein the holding ring is resiliently supported by fluid pressure acting on a first piston having a hollow stem.

5. Apparatus according to claim 4, wherein the hollow stem of the first piston is guided by recirculating ball bushes contained in tubular plinth upstanding from the closed end of the housing.

6. Apparatus according to claim 4, wherein the first piston is a slack fit in a liner in the housing, fluid seal being made by piston rings.

7. Apparatus according to claim 6, wherein the piston rings include at least one graphite ring.

8. Apparatus according to claim 7, wherein movement of the first piston is passed to the holding ring by pressure pins passing through in the floor of the inner housing.

9. Apparatus according to claim 8, wherein the pressure pins are guided on bearings in a transverse wall of the housing between the inner housing and the first piston.

10. Apparatus according to claim 4, wherein the hollow stem of the first piston guides a second piston which urges the sleeve to rise after shaping of the end wall of the container.

11. Apparatus according to claim 10, wherein a passage way extends from the side wall of the housing to a tubular plinth to permit application of fluid pressure to the underside of the second piston.

12. Apparatus according to claim 11, wherein pressure pins passing through the floor of the inner housing pass movement of the ejector piston to the ejector sleeve.

13. Apparatus according to claim 12, wherein the pressure pins are guided on bearings in a transverse wall of the housing between the inner housing and the first piston.

14. Apparatus for forming a profile in an end wall of a drawn or drawn and wall ironed container on a punch, said apparatus comprising:

a shape forming pad for deforming a central portion of the end wall to the desired profile, the shape forming pad being resiliently supported in a housing for limited motion relative to the housing in the direction of travel of the punch;

said housing includes a peripheral flange to permit fixing to a press, and a side wall portion of said housing being closed at one end to contain resilient support means for the shape forming pad;

wherein the shape forming pad is guided by linear roller bearings arranged around its periphery.

15. Apparatus according to claim 14, wherein the axis of pad travel is horizontal, a first pair of bearings are fixed spaced apart at 90° on the underside of the shape forming pad and a second pair of bearings are adjustably located above the axis of pad travel to maintain pad guidance.

16. Apparatus according to claim 14, wherein the shape forming pad is fixed to a floor of a hollow inner housing, the side wall of which has an outwardly directed flange extending radially beyond the linear bearings.

17. Apparatus according to claim 16, wherein the flange of the inner housing is supported on an array of polyurethane springs, each being a loose fit in a respective cavity in the housing to permit expansion of girth when compressed.

18. Apparatus according to claim 17, wherein the spring cavities are connected by passages to permit introduction of pressurised fluid to assist elastic recovery of the polyurethane springs after release of compressive load.

19. Apparatus according to claim 18, wherein fluid pressure is contained in the cavities by a first seal between the flange of the inner housing and a retaining annulus fixed to the housing, and a second seal between the side wall of the inner housing and a side wall of the housing.

20. Apparatus according to claim 17, wherein fluid pressure is contained in the cavities by a first seal between the flange of the inner housing and a retaining annulus fixed to the housing, and a second seal between the side wall of the inner housing and side wall of the housing.

21. Apparatus according to claim 16, wherein the inner housing is moveable a distance of up to ⅛" (3.175 mm) limited in normal use by the polyurethane springs to between one and two times the thickness of the bottom of the container.

22. Apparatus according to claim 16, wherein the flange of the inner housing is retained in the housing by an annular plate.

23. Apparatus according to claim 22, wherein the annular plate has a sealing ring to make a wiping seal against the flange of the inner housing.

* * * * *

UNITED STATES PATENT AND TRADEMARK OFFICE

CERTIFICATE OF CORRECTION

PATENT NO. : 6,070,447
DATED : June 6, 2000
INVENTOR(S) : Bone et al.

It is certified that error appears in the above-identified patent and that said Letters Patent is hereby corrected as shown below:

TITLE PAGE:

Item [56] References Cited

The following references should be added:

U.S. PATENT DOCUMENTS

| | | | | |
|---|---|---|---|---|
| 4,289,014 | 09/15/81 | Maeder et al..... | B21D | 22/24 |
| 4,930,330 | 06/05/90 | Weishalla..... | B21D | 22/30 |
| 4,372,143 | 02/08/83 | Elert et al..... | B21D | 22/24 |

FOREIGN PATENT DOCUMENTS

| | |
|---|---|
| 89/07021 | 8/1989 WO |
| 92/04143 | 3/1982 WO |

Signed and Sealed this

Seventh Day of August, 2001

*Attest:*

Nicholas P. Godici

*Attesting Officer*

NICHOLAS P. GODICI
*Acting Director of the United States Patent and Trademark Office*